US005248215A

United States Patent [19]

Fladung

[11] Patent Number: 5,248,215

[45] Date of Patent: Sep. 28, 1993

[54] ROAD BARRICADE

[75] Inventor: Manfred Fladung, Mömbris, Fed. Rep. of Germany

[73] Assignee: Manfred Fladung GmbH, Fed. Rep. of Germany

[21] Appl. No.: 741,443

[22] PCT Filed: Feb. 14, 1990

[86] PCT No.: PCT/EP90/00233

§ 371 Date: Aug. 7, 1991

§ 102(e) Date: Aug. 7, 1991

[87] PCT Pub. No.: WO90/09487

PCT Pub. Date: Aug. 23, 1990

[51] Int. Cl.[5] ..... E01F 13/00

[52] U.S. Cl. ..... 404/6; 49/33

[58] Field of Search ..... 49/35, 49, 131, 33; 403/83, 109; 52/298; 404/6, 11-13

[56] References Cited

U.S. PATENT DOCUMENTS 2,913,906 11/1959 Sinclair ..... 49/35 X
4,050,190 9/1977 Mazzone ..... 49/35
4,934,097 6/1990 Quante ..... 404/6 X

FOREIGN PATENT DOCUMENTS 92282 10/1983 European Pat. Off. .
3712019 10/1988 Fed. Rep. of Germany .

*Primary Examiner*—Ramon S. Britts
*Assistant Examiner*—Roger J. Schoeppel
*Attorney, Agent, or Firm*—Jordan B. Bierman

[57] ABSTRACT

A road barricade can be swiveled upward from its open position parallel to the road surface; in which its U-shaped cross-section overarches the drive mechanism, about a shaft secured to the ground, into barricade position. To this end it has, on the side nearer the ground in the open position, a pair of guide curves, or a pair of rectilinear guide ramps along which a pair of feed rollers move, which are mounted on a threaded muff which slides on a drive spindle. This drive spindle is guided by running wheels on the base plate of the barrier and carries a protective tube which surrounds the spindle. In an approximately vertical position, the common shaft butt ends of the feed rollers and the running wheels engage in curved grooves in the barricade element; the barricade element is swivelled downward in a controlled manner under its own weight by the co-operation of the guide lines with the feed rollers. At least the free end region of the barricade element can be flexible, and at least the drive region can be heatable.

13 Claims, 4 Drawing Sheets

ROAD BARRICADE

DESCRIPTION

The invention relates to a road barricade, in particular a car park barricade, that is fastened to the road surface and that has a barricade element optionally positionable parallel to the road surface or in a position at an angle thereto, said barricade element being swivellable upwards about an axis parallel to the road surface and vertical to the blocking direction by means of a drive mechanism comprising a spindle element.

A corresponding barricade for car parks is known from German patent DE-U-8 708065. Along a spindle element fixed on the road surface is moved a threaded bush from which extends a plate connected by an articulated joint to the barricade element for swivelling the barricade element by moving the sleeve. The barricade element is swivelled up and down by a forced drive mechanism.

The object of the present invention is to develop a road barricade of the type described above such that automatic blocking and opening of the road surface can be achieved with simple design means. It should also be ensured that the risk of injury is ruled out, particularly contusions when the barricade is swivelled up into the non-blocking position. Furthermore, the drive mechanism and the spindle element must be accessible even when the drive mechanism, for example, is out of order, thus permitting maintenance and repair work.

The object is substantially attained in accordance with the invention in that the barricade element has, facing away from the road surface, at least one feed line/curve along which an adjustable sliding element can move for swivelling the barricade element. The distance between the feed line/curve and the road surface, seen from the rotary axis of the barricade element, can increase towards its free end or initially decrease and then increase.

The curve path of the feed line last described follows a geometry similar to a curve with a minimum in the area of the road surface. As a result, an even swivel upwards and downwards of the barricade element is assured. Equal swivel angles can be covered in the same units of time.

Accordingly, it is possible with simple design means to swivel the barricade element upwards, with the downward swivel being assured by gravity. This return swivel motion is not however an abrupt one; there is a delaying effect caused by the interaction of the feed line/curve and the returning sliding element. As a result, the risk of contusions from downward swivelling of the barricade element is ruled out.

The drive mechanism preferably operates the spindle element, such as a recirculating ball screw, that is parallel to the road surface and covered by the barricade element when the latter is parallel to the road surface, by means of which element a sliding block or roller carrier containing the sliding element is movable. Feed wheels can extend from the sliding element that interact with the feed line/curve to swivel the barricade element.

To protect the drive mechanism, which can be an electric motor, known from small power tools such as drills, for example, a slipping clutch can be provided between the spindle element and the drive mechanism itself.

A gearbox is preferably connected between an electric motor and the spindle or element having the same effect, in order to permit setting of a desired swivelling speed. In addition, the motor can be switched off by means of a current limiter, i.e. the voltage supply is interrupted when the motor draws too much current.

Two feed lines/curves symmetrical to the longitudinal axis of the spindle element are preferably provided that are formed by the edges of flanges which in their turn are provided with a cladding to form the barricade element. The flanges themselves are passed through by the rotary axis or shaft, so that a cladding material can accordingly be selected that is quite thin. The cladding can be U-shaped in section.

It is also possible to design at least the free end of the barricade element flexible, for example by spiral element sections.

The sliding block passed through by the spindle element runs in controlled manner in the base plate. For this purpose, running wheels can extend from the sliding block that are guided laterally along or on raised sections extending from the base plate.

In order both to protect the spindle element such as a recirculating ball screw and to rule out any risk of injury when operating the spindles, it is furthermore provided that a protective tube extends from the sliding block to surround the free end of the spindle element. To protect the spindle element between the sliding block and the drive mechanism, a bellows-type hose that can extend between the sliding block and a bearing can be provided to hold the spindle.

Alternatively, the spindle can be inside a tube that is in its turn rigidly connected to the sliding element or roller carrier. In this case, the tube extending beyond the sliding block can be dispensed with.

Further details, advantages and features of the invention can be found not only in the claims and in the features stated therein - singly and/or in combination - but also in the following description of an embodiment shown in the drawings.

Figure 1:
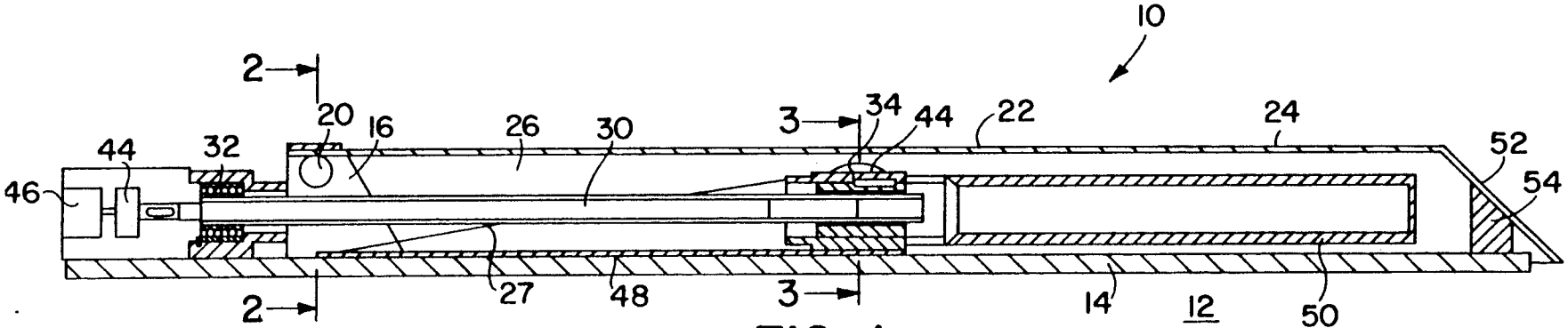
FIG. 1 shows a section through a barricade disposed on a road surface.

FIG. 1 shows a barricade (10) in accordance with the invention that is fastened directly to a road surface such as a parking surface (12) in order to block or open the latter to the extent required. The barricade (10) has a base plate (14) connected to the road surface by bolts, for example. Side pieces (16) and (18) project from the base plate (14) and have passing through them a shaft (20) about which a barricade element (22) such as a post or bollard can be swivelled.

The barricade element (22) comprises a cladding (24) of preferably U-shaped section open towards the parking surface (12). From the inner surface, preferably from the inner surface parallel to the parking surface (12) shown in FIG. 1, flanges (26) and (28) vertical to the base plate (14) extend that in their turn have a shaft (20) passing through them and are swivellable about said shaft. The flanges (26) and (28) can also be part of a U-shaped element open towards the base plate (14) and projecting from the cladding (24).

The flanges (26) and (28) each have a ramp-shaped feed line (27) and (29) using which the element (22) is swivelled in the manner described below.

Parallel to the base plate (14) and centrally between the side plates (16), (18) and flanges (26), (28) is a recirculating ball screw (30) supported by a bearing (32) and holding a sliding block (34). Turning the spindle (30) therefore moves the sliding block (34) axially.

Since feed rollers (36) and (38) interacting with the feed lines formed by the lower edges (40) and (42) of legs (26) and (28) extend from the sliding block (34), it is accordingly possible to raise the barricade element (22) by moving the sliding block (34) in the direction of the shaft (20). To do so, the recirculating ball screw (30) is connected preferably via a slipping clutch (45) to an electric motor (47) that can be of a type known from small power tools such as drills. The drive mechanism can be activated by remote control, switches or the like.

The barricade element (22) is, in the projecting position, preferably at a slight angle to ensure gravity lowering of the element when the sliding block (34) is moved back. This however ensures that abrupt lowering, which harbours the risk of contusion, is prevented, since only a gradual downward motion is possible given the distance of the sliding block (34) from the shaft (20) thanks to the interaction of the feed lines (27) and (29) with the feed rollers (36) and (38).

For guidance of the sliding block to the required extent, it has running wheels (44) and (46) that run laterally on a raised section (48) extending from the base plate (14).

The front free end of the spindle (30) is surrounded by a protective tube (50) extending from the sliding block (34). The area between the bearing (32) and the sliding block (34) can in its turn be protected by a bellows-type hose, not illustrated.

The cladding (24) is rectangular and open towards the base plate (14). In the front sloped end (52), a supporting element (54) is provided that can be rested on the base plate (14).

It is also possible to design at least the free end of the barricade element (22) flexible in order to avoid damage to a motor vehicle should the barricade (10) be driven over while in the blocking position.

Figure 4:
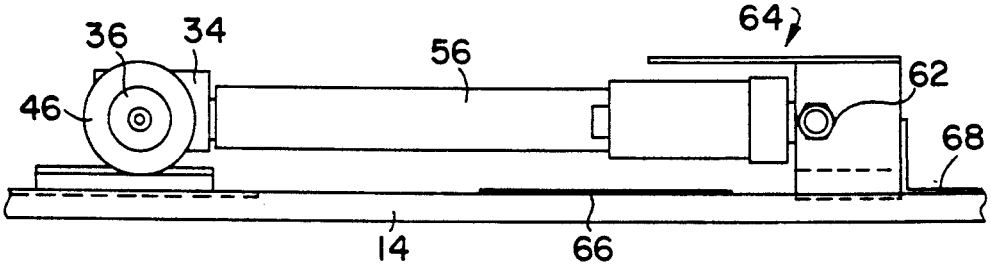
FIG. 4 shows part of a further embodiment of a barricade.
Figure 5:
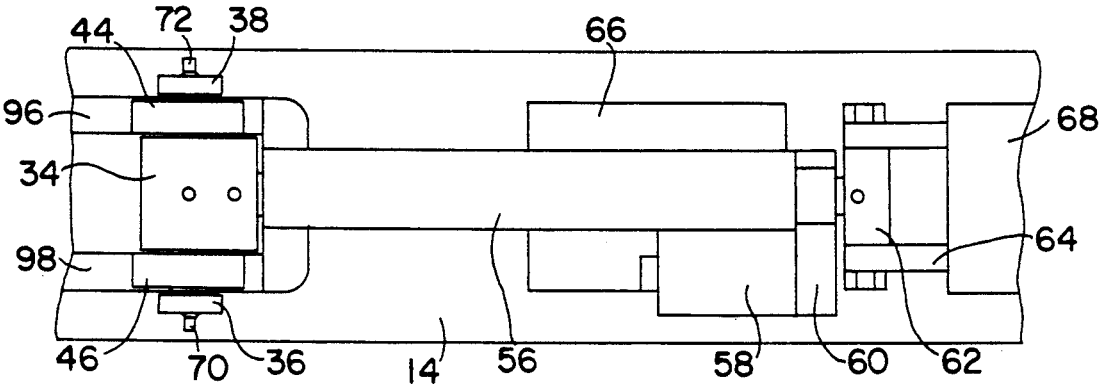
FIG. 5 shows the section from FIG. 4 in plan view.

FIGS. 4 and 5 are preferred embodiments of a barricade with the same design and function principle as the barricade (10).

Figure 3:
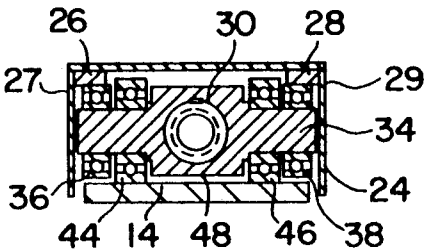
FIG. 3 shows a section along the line 3—3 in FIG. 1.
Figure 2:
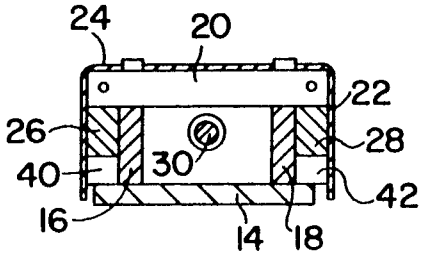
FIG. 2 shows a section along the line 2—2 in FIG. 1.

The embodiments in FIGS. 4 and 5 differ however from those in FIGS. 1 to 3 in that the sliding block, which is also designated as roller carrier (34), is firmly connected to a mounting such as a tube (56), in which the recirculating ball screw, not illustrated, is rotatably disposed. As a result, the tube (56) more or less surrounds the recirculating ball screw, depending on whether the sliding block (34) is in the vicinity of the swivel axis (20), i.e. when the barricade element is raised, or in the returned position, in which the barricade element is resting on the base plate (14).

As FIGS. 4 and 5 also make clear, an electric motor (58) is swivellably attached via a gearbox (60) to a shaft (62) which in its turn extends from a mounting (64) attached to the base plate (14).

The motor (58) can be a 24 V motor with a current limiter. As a result, a slipping clutch can be dispensed with. If an inadmissible force acts on the barricade element, the motor (58) would draw an inadmissibly large current. In this case, the current limiter has the effect of interrupting the voltage supply to the electric motor (58).

To permit operation of the barricade in cold weather too, particularly in frosty conditions, heater elements in the form of foil heaters (66), (68) are provided in the area of the motor (58) and the gearbox (60) and can be operated by a thermostat.

Concerning the sliding block or roller carrier (34), it should be noted that the running wheels (44) and (46) are guided on raised rail-like sections (96) and (98). The feed rollers (36) and (38) interacting with the feed lines (27) and (29) are disposed on the outside.

The shaft passing through the feed rollers (36) and (38) and the wheels (44) and (46) has outward-projecting shaft butt ends (70) and (72) engaging in curved grooves (74) preferably inside the side pieces (16) and (18) of the cladding (24). This engagement of the butt ends (72) and (70) in the curved grooves (74) takes place just before the barricade post is swivelled into the vertical position. When the roller carrier (34) is moved back, the barricade post is accordingly moved too, but with the shaft ends (70) and (72) disengaging from the curved grooves (74), i.e. with the barricade post becoming movable again once the gravity acting on it is sufficient to ensure automatic downward swivel of the barricade post. These measures ensure that the risk of contusion as ruled out by the barricade in accordance with the invention is also ruled out when the barricade post is moved into a vertical position.

Figure 6:
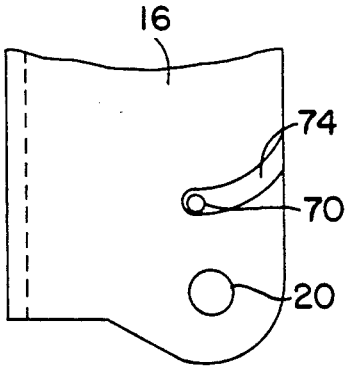
FIG. 6 shows a section from the cladding of a barricade.

FIGS. 7 to 10 show particularly noteworthy embodiments of a barricade (80), with the same reference numbers being used for elements already described in connection with FIGS. 1 to 6. It can also be seen from the sectional views that substantial elements of the embodiments of FIGS. 4 to 6 are present in the barricade (80).

Figure 7:
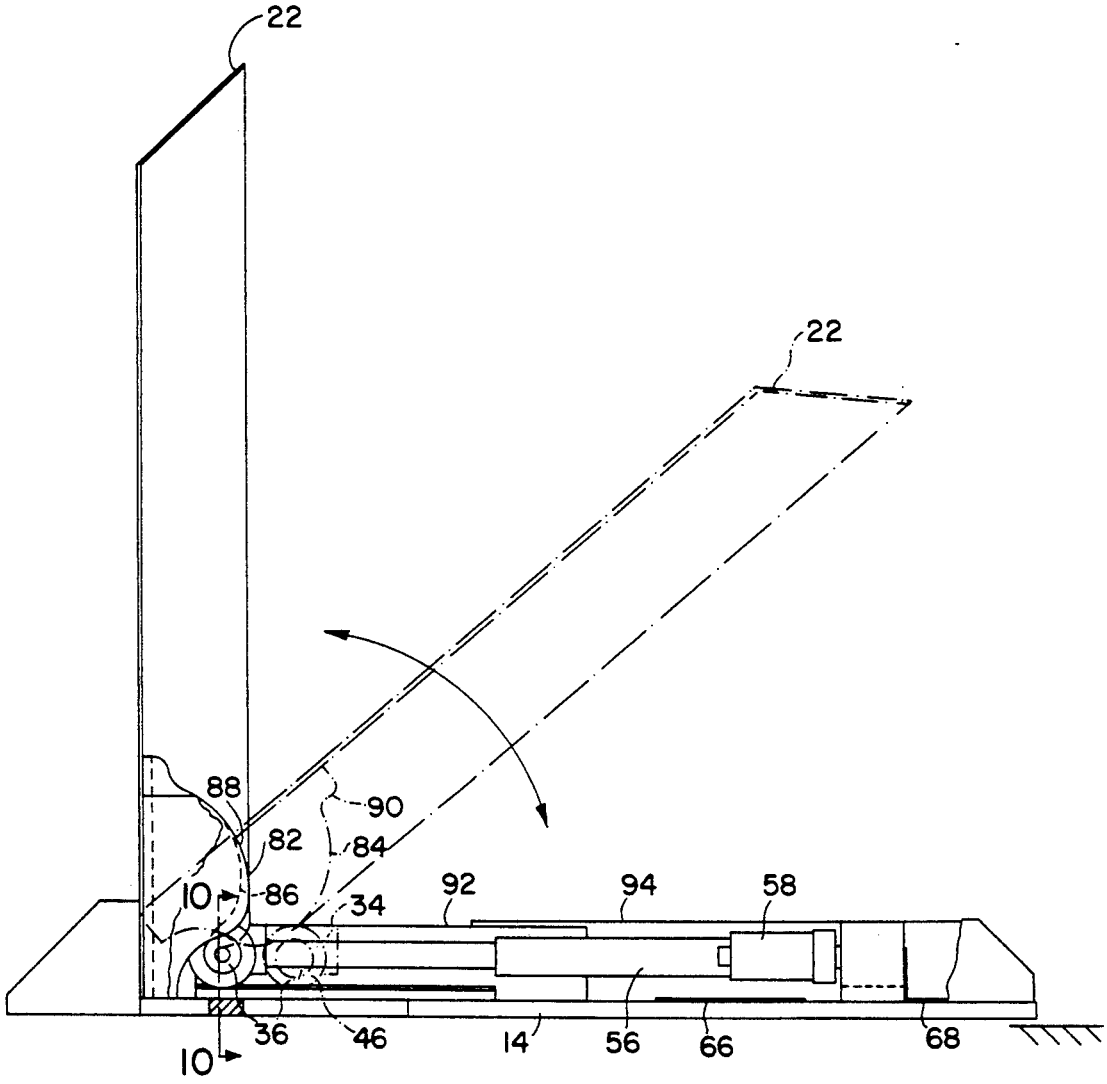
FIG. 7 shows a side view of a particularly noteworthy embodiment of a barricade, partly cutaway.
Figure 8:
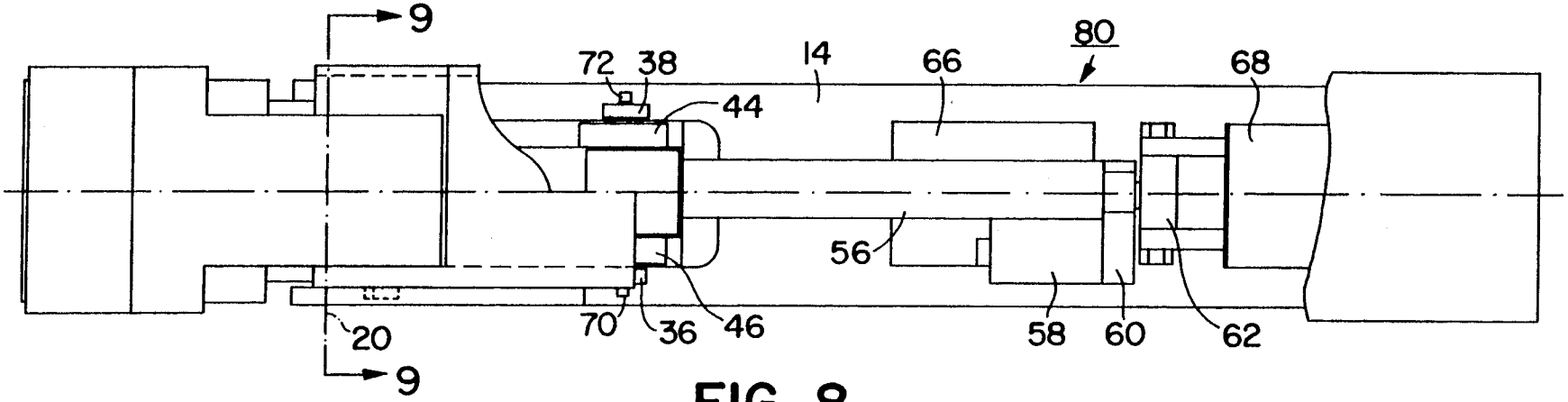
FIG. 8 shows a plan view of the barricade according to FIG. 7, partly cutaway.

The main difference between the barricade (80) and the barricade (10) is the design of the feed curves interacting with the feed rollers, partially shown in a dashed line and numbered (82) in FIG. 7.

The feed curve (82) rises, seen from the axis (20) in the direction of the base plate (14), at first continuously (section 84), and then follows a plateau (86) section by section that is parallel to the base plate (14) when the barricade element (22) is lowered. The feed curve (82) then falls continuously, i.e. the distance from the base plate (14) increases. This is made clear by the partly continuous line (88). Around the end, a section (90) can be discerned that is horizontal when the barricade element (82) is lowered and that interacts with the feed roller (36) at the start, i.e. when the barricade element (22) is to be raised.

This path of the feed curve (82) ensures that equal swivel angles can be covered in the same units of time by the barricade element, so that an even raising and lowering of the barricade element (22) is achieved.

It can also be seen from FIG. 7 that the curved groove (74) is in sections approximately parallel to the curve section (84) of the feed curve (82).

Figure 10:
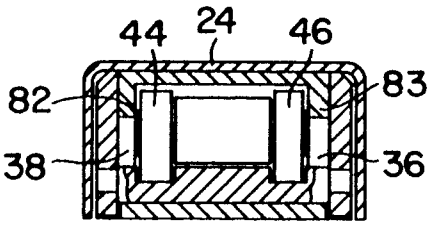
FIG. 10 shows a section along the line 10—10 in FIG. 7.
Figure 9:
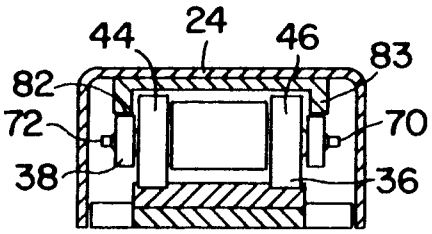
FIG. 9 shows a section along the line 9—9 in FIG. 8.

The sectional views in FIGS. 9 and 10 also show that the feed lines/curves (82), (83), are flanges of a U-shaped section open towards the base plate (14) attached to the inside of the cladding (24).

As the sectional view in FIG. 10 makes clear, the side walls of the barricade element (22) are reinforced in the area in which the shaft butt ends (70) and (72) interact with the curved grooves (74).

The cladding (24) itself can if necessary be broken off at preset breaking points—not described in detail—without damaging the mechanical drive mechanism. This measure may be necessary when, for example, the barricade element cannot be swivelled back for some reason although the barricaded surface must be completely accessible.

Concerning FIG. 7, it should further be mentioned that the area of the drive mechanism is covered with a U-shaped element (92) extending from the sliding block or roller carrier (34). This protective element (92) is covered in its turn by a stationarily disposed protective element (94) extending from the holding means for the drive mechanism. These measures too ensure in addition that the area of the drive mechanism is not freely accessible, so that a high degree of safety is assured.

I claim:

1. A road barricade fastened to a road surface comprising a barricade element pivotable about an axis for optionally positioning said barricade element parallel to said road surface or in a position at an angle thereto by means of a drive mechanism wherein, said barricade element has at least one feed line facing said road surface, said feed line having a distance to said road surface which increases in a direction of a free end of said feed line opposite said axis, a sliding element, on which said feed line rests, being movable along said feed line for pivoting said barricade about said axis, said sliding element being driving by a drive mechanism comprising a rotatable spindle element running parallel to said barricade element when said barricade element is in a position parallel to said road surface, for erecting said barricade element.

2. A road barricade according to claim 1, wherein said feed line is of ramp shape, with the distance from said feed line to said roadway surface increasing towards its free end, seen from the rotary axis of said barricade element.

3. A road barricade according to claim 1, wherein said feed line (82, 83) initially rises, seen from the rotary axis of said barricade element, in the direction of said roadway surface (12), follows a plateau (86), and then moves away from the roadway surface.

4. A road barricade according to claim 1, wherein two feed lines symmetrical to the longitudinal axis of said spindle element are provided that are formed by edges of of flanges which are provided with a preferably U-shaped cladding as part of said barricade element or which extend from said barricade element or which themselves form said barricade element and extend swivellably from said shaft.

5. A road barricade according to claim 1, wherein said barricade element attachable with said drive mechanism to said roadway surface is swivellable substantially under gravity from the position projecting from said roadway surface to the position parallel to said roadway surface.

6. A road barricade according to claim 1, wherein said drive mechanism operates the spindle element that is parallel to said road surface and covered by said barricade element when the latter is parallel to said road surface, by means of which a sliding block is movable.

7. A road barricade according to claim 1, wherein a slipping clutch is disposed between said drive mechanism and said spindle element.

8. A road barricade according to claim 1, wherein at least the free end of said barricade element is flexible.

9. A road barricade according to claim 5, wherein said sliding block is guided by a base plate forming the base of said road barricade and attachable to said roadway surface.

10. A road barricade according to claim 9, wherein said sliding block has running wheels that run laterally along a raised section extending from the base plate.

11. A road barricade according to claim 1, wherein the free end of said spindle element is surrounded by a protective tube extending from said sliding block.

12. A road barricade according to claim 1, wherein said running wheels and feed rollers interacting with said feed lines extend from a common shaft having butt ends on the outside that interact with curved grooves provided in the cladding or walls of said barricade element when the latter is in an approximately vertical position.

13. A road barricade according to claim 1, wherein at least in the area of said drive mechanism a heater is provided such as a foil heater disposed on said base plate.

* * * * *